US005975660A

United States Patent [19]

Tisbo et al.

[11] Patent Number: 5,975,660

[45] Date of Patent: Nov. 2, 1999

[54] CABINET

[75] Inventors: Thomas A. Tisbo, Barrington Hills; Torrence C. Anderson, Aurora; Michael G. Uffner, Naperville; Brian R. Moon, Dekalb; Michael R. Vogler, Aurora, all of Ill.

[73] Assignee: Suncast Corporation, Batavia, Ill.

[21] Appl. No.: 09/089,279

[22] Filed: Jun. 2, 1998

[51] Int. Cl.[6] ..... A47B 47/00

[52] U.S. Cl. ..... 312/263; 312/209; 312/108; 312/265.2

[58] Field of Search ..... 312/400, 263, 312/257.1, 108, 111, 265.5, 329, 351, 326, 351.3, 351.1, 206, 258, 265.1, 265.2, 209

[56] References Cited

U.S. PATENT DOCUMENTS

| | | | |
|---|---|---|---|
| 2,483,606 | 10/1949 | Albach et al. | 312/329 X |
| 2,722,468 | 11/1955 | Perrin | 312/265.2 |
| 2,999,730 | 9/1961 | Troutman | 312/265.2 |
| 4,201,428 | 5/1980 | Johnson | 312/108 X |
| 4,691,644 | 9/1987 | Frydman | 312/265.5 X |
| 5,221,131 | 6/1993 | Lesperance et al. | 312/263 |
| 5,368,380 | 11/1994 | Mottmiller et al. | 312/111 X |
| 5,372,415 | 12/1994 | Tisbo et al. | 312/263 X |
| 5,466,058 | 11/1995 | Chan | 312/263 X |
| 5,605,344 | 2/1997 | Insalaco et al. | 312/209 X |

FOREIGN PATENT DOCUMENTS

| | | | |
|---|---|---|---|
| 716247 | 12/1931 | France | 312/263 |
| 2157761 | 5/1973 | Germany | 312/265.5 |

*Primary Examiner*—Peter M. Cuomo
*Assistant Examiner*—James O. Hansen
*Attorney, Agent, or Firm*—Welsh & Katz, Ltd.

[57] ABSTRACT

A cabinet includes a pair of spaced apart opposingly oriented, molded side panels, a molded rear panel disposed between the side panels at first edges thereof and joined thereto, a molded top panel disposed at an uppermost edge of the side and rear panels, a molded base panel in spaced, opposing relation to the top panel, disposed at a bottommost edge of the side and rear panels and a pair of pivotal, molded front door panels disposed in opposing relation to the rear panel and between the side panels and pivotally joined thereto. The cabinet includes corner support posts positioned at at least two corners that extend between the base panel and the top panel. The posts that traverse through and join the respective side panels with the door panels define front corners forming pintles defining axes for pivoting the door panels relative to the side panels. The cabinet includes clamping members for securing the posts to the top and base panels, through the cabinet corners. The cabinet includes shelves and bins that are height adjustable that slide along rails formed in the cabinet side panels.

24 Claims, 10 Drawing Sheets

CABINET

FIELD OF THE INVENTION

This invention pertains to cabinets. More particularly, the invention pertains to cabinets formed from molded structural panels and having reinforced steel core corner posts.

BACKGROUND OF THE INVENTION

Cabinets, and more particularly, storage cabinets can be found in every commercial enterprise and residence. These cabinets range from modern, sleek, custom-made cabinets, to "older" kitchen cabinets subsequently hung in a basement, laundry room or a garage to provide additional storage space.

While the requirements for these cabinets and the environment to which they may be subjected vary widely, they all have one common need. That is, these cabinets must be able to contain whatever is stored within them. As such, many of these cabinets include shelves that are either stationary or adjustable to accommodate stored items of varying heights. The cabinets must also be sufficiently deep and sufficiently wide to store whatever is necessary to be contained therein.

The materials of construction of known cabinets vary from wood or pressboard materials to sheet steel, plastic and composite materials and the like. While each of these materials have their advantages, they also have their disadvantages. For example, wood and pressboard cabinetry generally cannot be used in an area where the cabinet may be subject to outdoor environments, or wide variations in humidity and temperature. These materials can degrade over time and, as such, they tend to require replacement on a fairly frequent basis. Nevertheless, these cabinets are well-suited for indoor use, for storage of non-liquid materials and the like.

Steel cabinets, if properly finished, can be used in outdoor environments with success. However, steel cabinets are subject to oxidation, e.g., rusting, if the finish is not properly applied to the steel or if the finish is in some way damaged, such as by scratching through the finish. While steel cabinets can be used in wider variety environments, they too have their drawbacks. First, steel cabinets can be heavy or difficult to move if necessary. Steel can also be easily damaged or dented if the material gauge is high (i.e., thin cabinet walls). In addition, while steel cabinets may be functionally sound, they often do not have an appealing or aesthetically pleasing appearance. Steel cabinets can also have edges that can include spurs or sharp portions that can result in cuts and abrasions for people frequently using or moving the cabinets.

Cabinets formed of plastic and composite materials fill a long felt need for cabinetry that can be used in a tremendously wide variety of environments, that can be used to store considerably heavy items, and that can provide an aesthetically appealing appearance. While these cabinets provide a considerable number of advantages over the known wood and pressboard materials, as well as steel materials, they too have their drawbacks. First, over time the cabinets can tend to shift or deform at the corners. This deformation, while minor, can result in improper fit of the panels to one another and improper opening and closing of the cabinets. This can be particularly troublesome when the cabinet is used on a frequent basis, and when the cabinet is in a location in which it is readily opened to view.

In addition, many such cabinets are constructed using "push-pins" to maintain the separate panels connected to one another. While this method of connecting panels to one another provides for easy assembly of the cabinet, the "push-pins" can fracture over time and the cabinet panels can thus come apart from one another.

Other plastic or composite cabinet construction requires that the panel sections be interlocked with one another to assemble the cabinet. While this too may be a readily easily carried-out assembly method, it does not provide positive locking of the panels and components to one another. Still other types of cabinet construction require other numerous small items, screws, bolts and the like be inserted into the panels and connected to one another to maintain or increase the structural integrity of the unit. Such construction, as will be recognized by a "do it yourself" type of individual, can be quite difficult and time consuming and can result in a less than structurally sound cabinet unit.

Accordingly, there exists a need for a cabinet formed of a plastic or composite material that can be subjected to a wide range of environments including both wet and high-humidity conditions. Desirably, such a cabinet is structurally sound and includes positive locking features to interlock the panels to one another. Such a cabinet includes structurally strengthened corner members to prevent sagging of the cabinet and to provide a hinge element about which the cabinet doors can pivot. Most desirably, such a cabinet can be readily assembled with few or no tools, in relatively little time.

SUMMARY OF THE INVENTION

A cabinet includes a pair of spaced apart opposingly oriented, molded side panels, a molded rear panel disposed between the side panels, a molded top panel disposed at an uppermost edge of the side and rear panels, a molded base panel in spaced, opposing relation to the top panel, disposed at a bottommost edge of the side and rear panels and a pair of pivotal, molded front door panels disposed in opposing relation to the rear panel, between the side panels and pivotally joined thereto.

The cabinet includes corner support posts positioned at at least the two front corners that extend between the base panel and the top panel. The front corner posts traverse through and join the respective side panels with the door panels defining front corners, and defining pintles for pivoting the front door panels, independently of one another, relative to the side panels. Alternately, posts can extend between the top and base panels at all four corners to define front and rear corners.

The posts are secured to the top and base panels at the corners by clamping means. In one embodiment, the clamping means includes a partially threaded sleeve extending from the base or top, that includes longitudinal slots formed therein. A threaded coupling nut having an inwardly tapered inner surface threadedly engages the sleeve so that the tapered surface compresses the sleeve about the slots to clamp the sleeve onto the post. Alternately, the clamping means includes a circumferentially continuous sleeve extending from the top or base panel that has a locking projection extending from the panel and positioned on an inner surface of the sleeve. The post used with this clamping arrangement includes a slot adapted to engage the locking projection. Preferably, the slot includes serrations to secure the post to the locking projection. This arrangement can also further include a second, partial circumferential sleeve coaxial with the first sleeve to serve as a protecting sleeve or shroud for the inner clamping sleeve.

The cabinet rear panel can be formed from a pair of side-by-side panel sections engaged with one another to form a substantially rigid panel. The engaging configuration can include an engaging projection extending from an edge face of one of the panel sections that inserts into an opening in the other panel section. The engaging projection preferably includes a base portion and a transverse portion extending from the base portion to define a generally L-shaped element. The opening can be two-tiered, having a larger opening contiguous with a slot, with the larger opening having an open area sufficiently large to receive the transverse portion, and the slot having an open area sufficiently small to prevent the passage of the transverse portion therethrough.

To maintain the side and rear panels aligned with the base and top panels, the top and base panels can each include a peripheral channel or slots formed therein that extends around at least a portion of the panel, and the side and rear panels can each include one or more tab-like projections the extending from the ends thereof that are configured for receipt in the channels.

The cabinet side panels include a plurality of rails formed therein that correspond to rails formed in the other of the side rails. The rails are oriented inwardly of the cabinet for supporting a bin or a shelf positioned on and extending between the rails. The rails can include a projection or a notch and the shelf or bin can include a complementary notch or projection to lock the bin or shelf in place on the rails when the shelf or bin is in a fully inserted position in the cabinet.

The cabinets can be formed as base-type cabinets, tall cabinets, or wall-mount cabinets.

Other features and advantages of the present invention will be apparent from the following detailed description, the accompanying drawings and the appended claims.

DETAILED DESCRIPTION OF THE PREFERRED EMBODIMENTS

Figure 1:
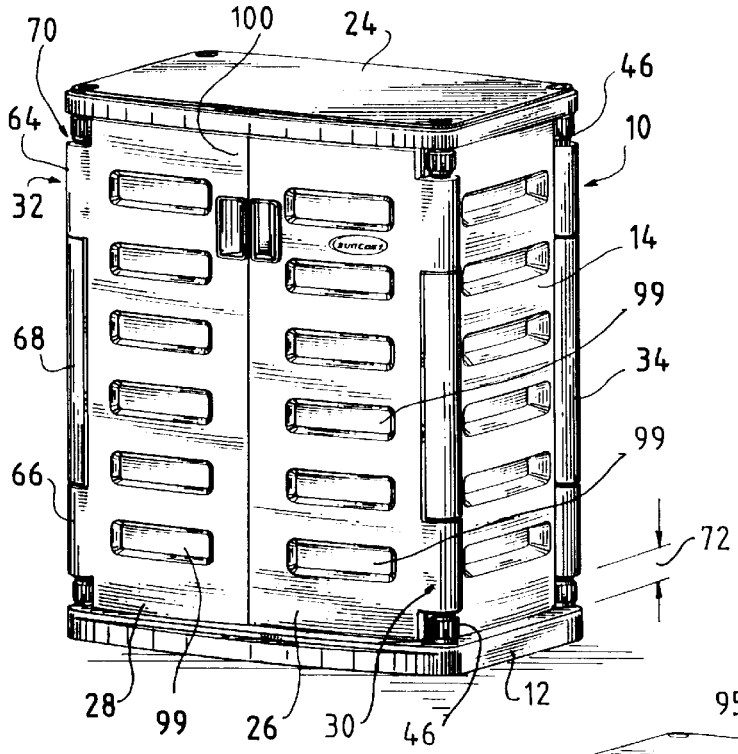
FIG. 1 is a perspective view of one embodiment of a cabinet in accordance with the principles of the present invention, the cabinet illustrated being a base-type cabinet.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated.

Referring now to the figures and particularly to FIG. 1, there is shown one embodiment of a cabinet 10 in accordance with the principles of the present invention. The cabinet 10 includes a base 12 that is preferably, substantially rectangular, opposingly oriented side panels 14, 16 that extend upwardly from the base 12, abutting, side-by-side rear panel sections 18, 20 that are secured to one another to define a rear panel 22, a top 24, and outwardly pivotal front door panels 26, 28. It will be apparent from the drawings that the base 12 is generally rectangular in shape, having slightly outwardly arched sides. This can also be the overall shape of the sides 14, 16, rear panel 22, the top 24 and front door panels 26, 28.

Figure 6:
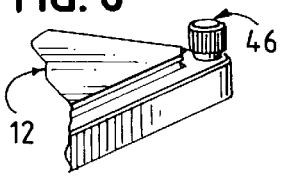
FIG. 6 is a partial perspective view of a rear corner of the base cabinet illustrating a threaded sleeve and nut clamping arrangement for mounting the posts to the base of the cabinet.
Figure 5:
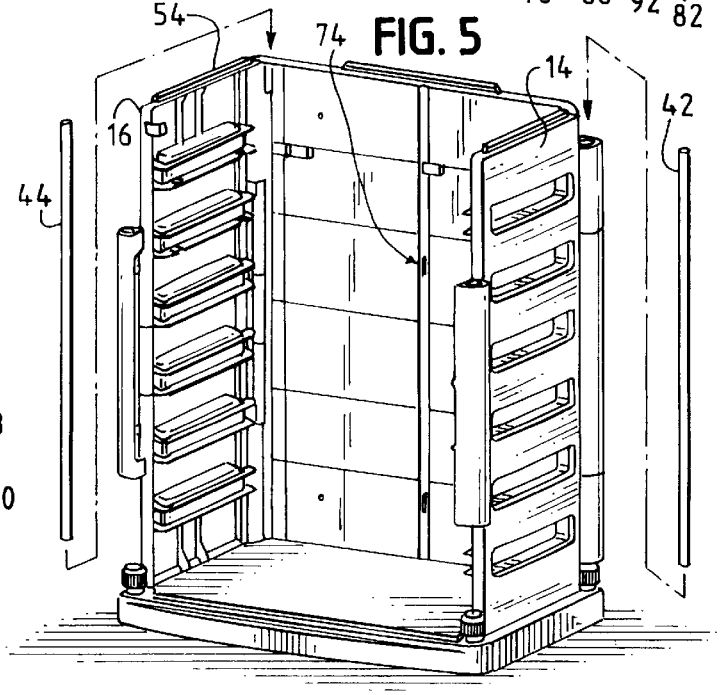
FIG. 5 is another perspective, partially exploded view of the base-type cabinet showing the corner support posts as they insert into the cabinet rear corners.
Figure 6A:
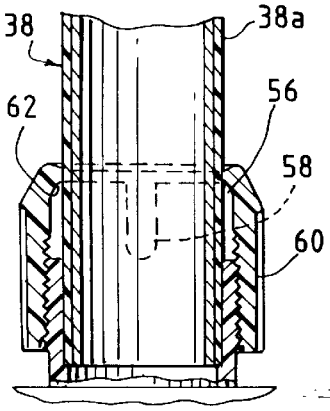
FIG. 6A is a cross-sectional view of the threaded sleeve and nut clamping arrangement of FIG. 6.

The panels 14–16 and 22–28 join to one another at corners 30–36, through which steel support posts 38–44 extend. In a preferred embodiment, the posts 38–44 have an external, impact-resistant plastic sleeve (illustrated at 38*a* in FIG. 6A), which provides a plastic casing, sheath and outer shell. The support posts 38–44 are maintained in place at the corners 30–36, at the base 12 and at the top 24 by clamping means, such as the exemplary, illustrated clamping members 46, which will be described in more detail herein.

The base 12 includes slots or channels 48 extending along the periphery thereof. The side and rear panels 14, 16, 22 each include a depending tab-like aligning element 50 that extends from the bottom of each panel 14, 16, 22 that is received in a respective portion of the base peripheral channel 48. Engagement of the tab-like elements 50 with the channels 48 ensures that the side and rear panels 14, 16, 22 are aligned with the base 12. Likewise, the top panel 24 includes channels 52 extending along its side and rear periphery and the side and rear panels 14, 16, 22 include complementary, upwardly extending tab-like aligning projections 54 that are received in the channels 52 to align the side and rear panels 14, 16, 22 with the top 24 when the cabinet 10 is assembled.

The corner support posts 38–44 extend between the base 12 and top 24 at each of the four corners 30–36 of the cabinet 10. To this end, clamping means secure the posts 38–44 to the top 24 and base 12. The exemplary clamping members 46 illustrated in FIGS. 6 and 6A, include a partially threaded sleeve 56 extending from the base 12 or top 24, which sleeve 56 includes longitudinal slots 58 formed therein. The clamping member 46 further includes a knurled, fluted, internally threaded coupling nut 60 having an inwardly tapered inner surface, illustrated at 62, that securely threadedly engages the sleeve 56. As the nut 60 threads onto the sleeve 56, the tapered surface 62 compresses the sleeve 56 about the slots 58 and thus clamps the sleeve 56 onto the post 38–44, securing the post 38–44 within the clamp 46, and thus to the base 12 or top 24.

Figure 26:
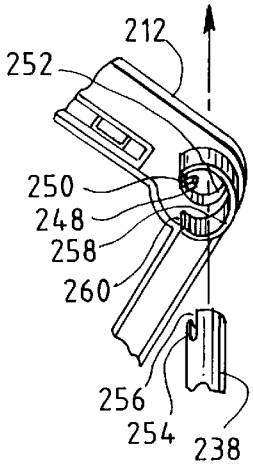
FIG. 26 is a partial perspective view of an upper corner of the cabinet illustrating an alternate coupling arrangement for mounting the post to the top panel of the cabinet.

An alternate embodiment 246 of the clamping means is illustrated in FIG. 26. The alternate embodiment 246 includes a circumferentially continuous sleeve 248 extending from the respective panel, for example base panel 212, with a locking projection 250 extending from the base panel 212 and positioned on an inner surface of the sleeve 248. The post 238 that is used with this clamping arrangement includes a slot 254 adapted to engage the locking projection 250. The slot 254 can include serrations 256 or like grasping elements to secure the post 238 to the locking projection 250 when the post 238 is inserted into the sleeve 248. This arrangement can further include a second, partial circumferential sleeve 258 outwardly of and coaxial with the first sleeve 248. This outer sleeve 258 has an enlarged open region 260 that extends substantially longitudinally along the sleeve 258. The outer sleeve 258 serves as a protecting sleeve or shroud for the inner clamping sleeve 248.

Figure 7:
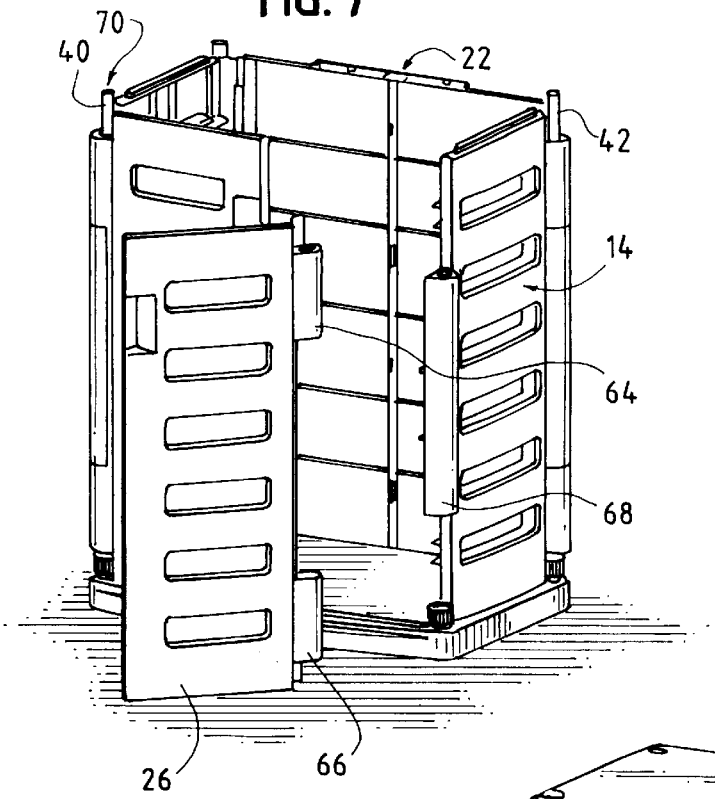
FIG. 7 is another perspective, partial view showing one of the front doors of the cabinet removed.
Figure 8:
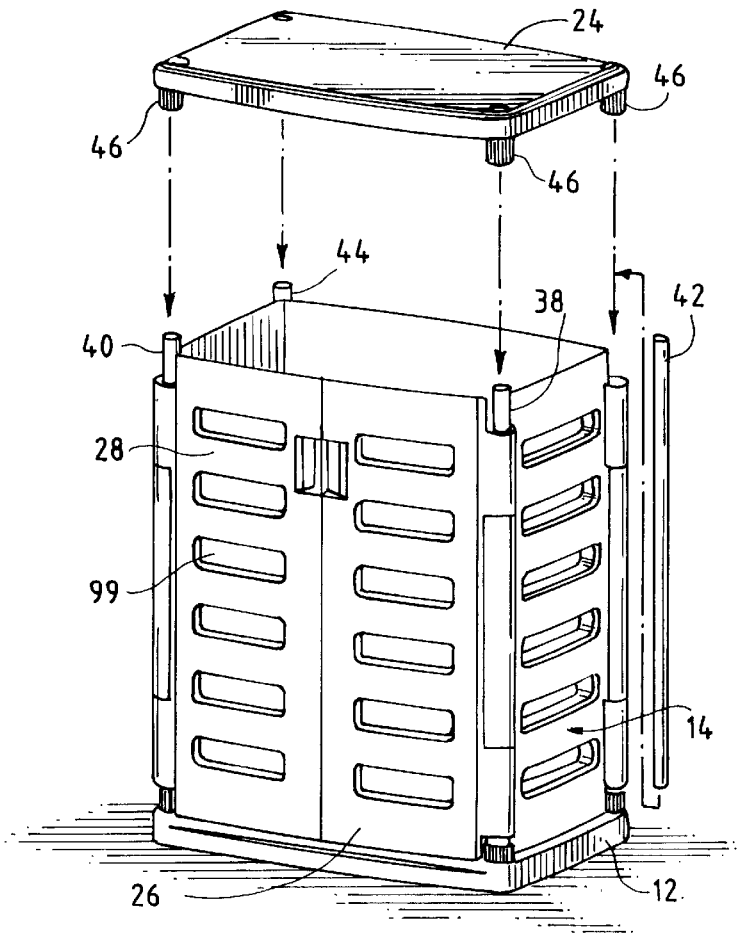
FIG. 8 is another perspective, partial view showing the top panel mounting to the base cabinet posts.
Figure 9:
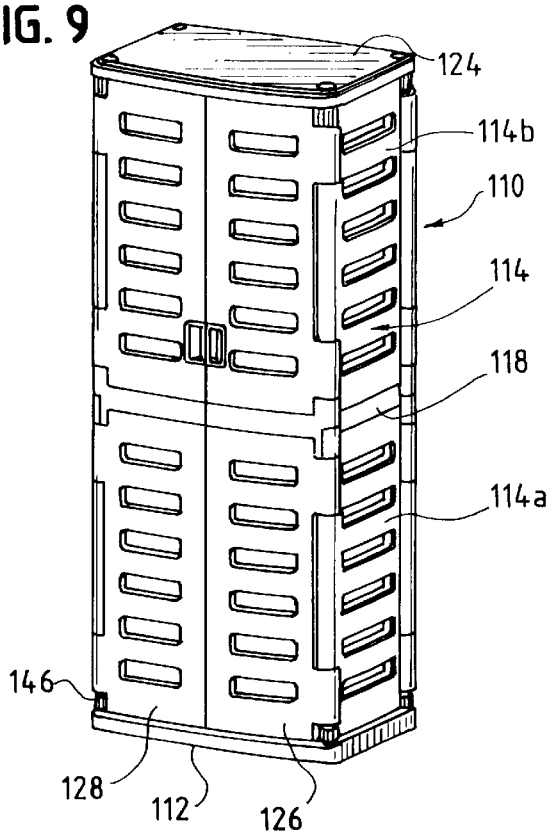
FIG. 9 is a perspective view of an alternate embodiment of a cabinet in accordance with the principles of the present invention, the cabinet illustrated being a tall-type cabinet.
Figure 10:
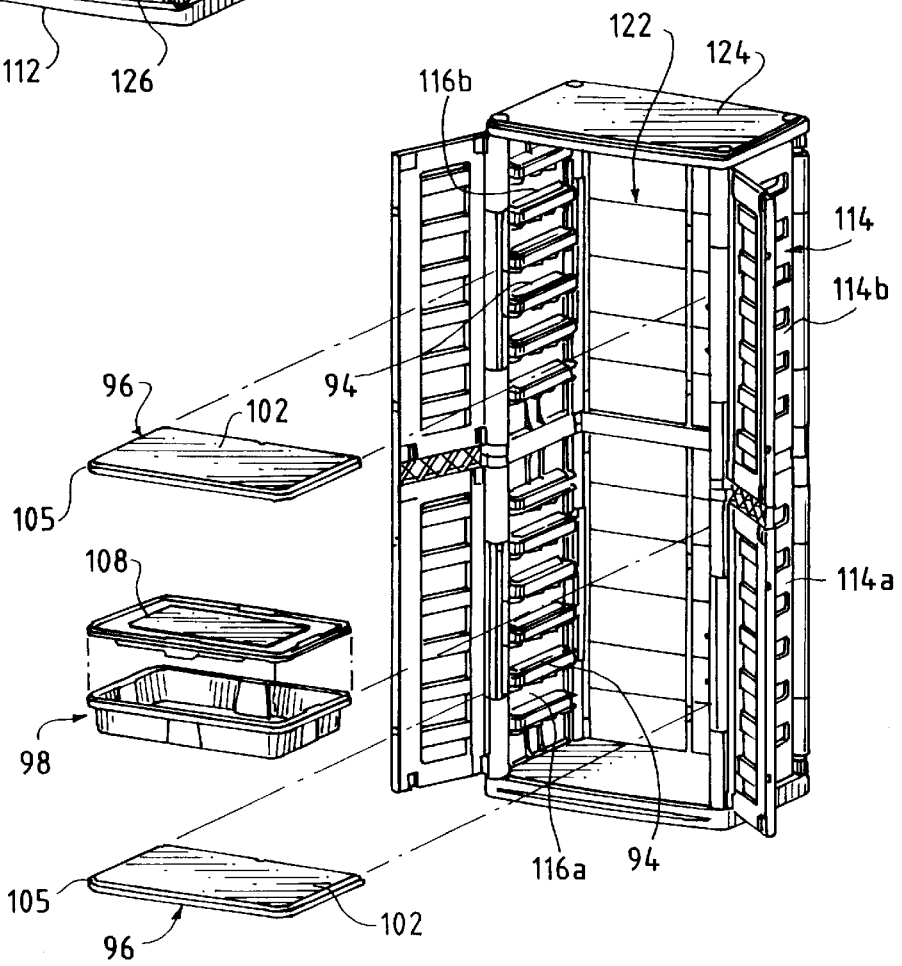
FIG. 10 is a perspective view of the cabinet of FIG. 9 illustrated with the doors in an open position, having a pair of adjustable shelves being positioned within the cabinet and showing a removable storage bin that can be fitted to the runners of the cabinets.
Figure 11:
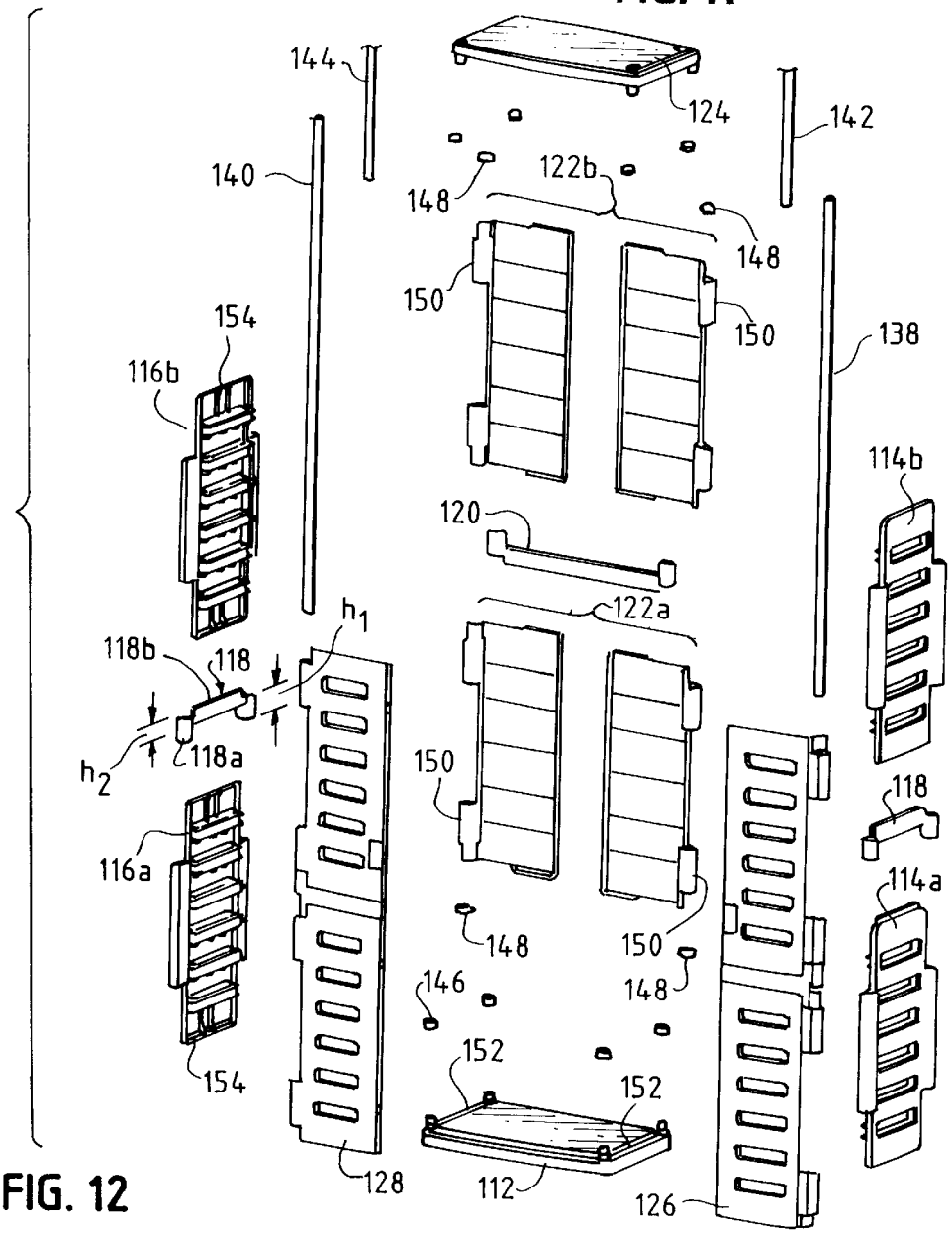
FIG. 11 is an exploded, partial view of the tall-type cabinet of FIG. 9 showing the panels removed from one another, and illustrating some of the various parts used to assemble the cabinet.
Figure 12:
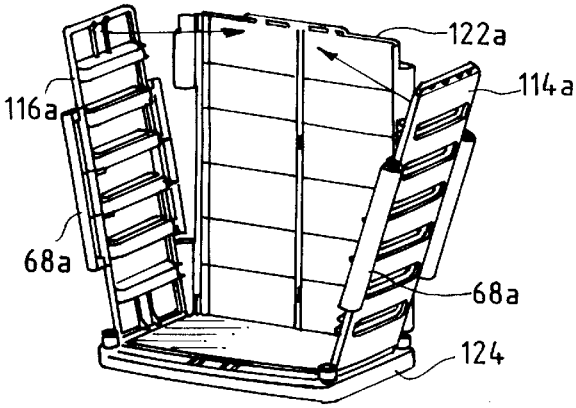
FIG. 12 is a partial perspective view of the tall-type cabinet showing the lower side panels and rear panels in a partial assembled arrangement relative to the base panel.
Figure 13:
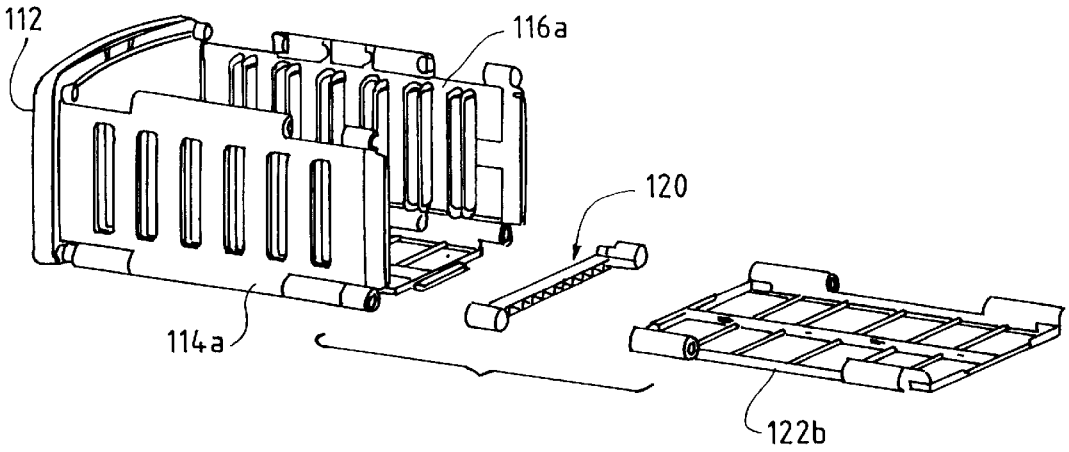
FIG. 13 is an illustration of the tall-type cabinet of FIG. 9 in partial assembly, the cabinet illustrated with the upper rear panel section being assembled to the lower portions of the cabinet.
Figure 14:
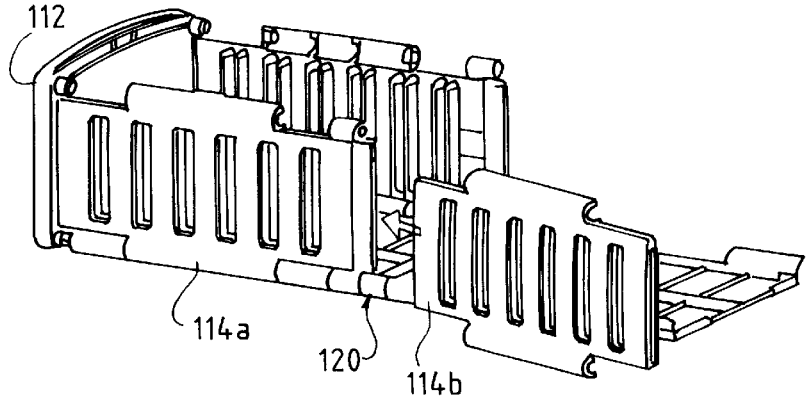
FIG. 14 illustrates the assembly step following that illustrated in FIG. 13, showing the upper side panel section being assembled to the partially constructed cabinet.
Figure 15:
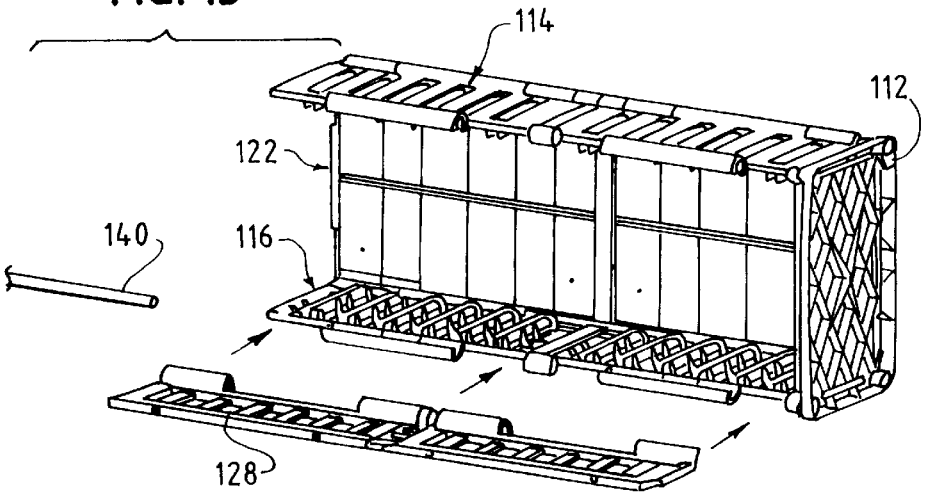
FIG. 15 illustrates the assembly step following that illustrated in FIG. 14, showing a front door panel being assembled to the partially constructed cabinet.
Figure 16:
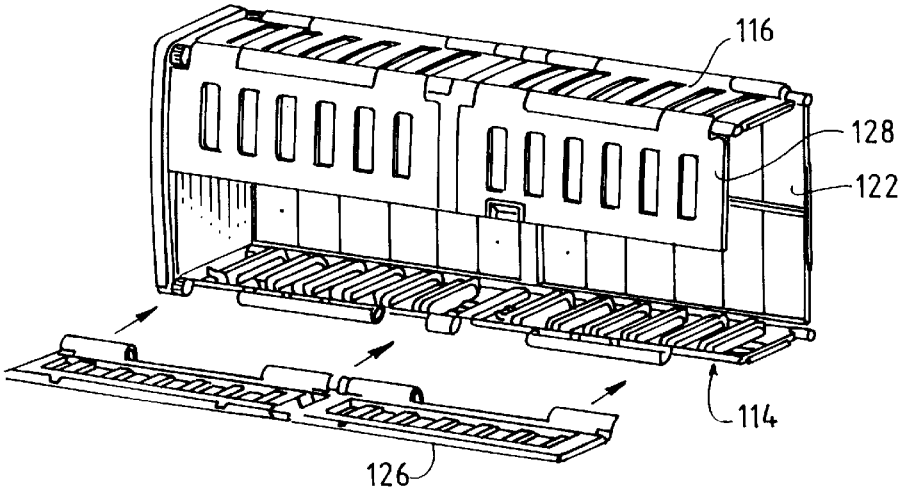
FIG. 16 illustrates the assembly step following that illustrated in FIG. 15, showing the other front door panel being assembled to the partially constructed cabinet.
Figure 17:
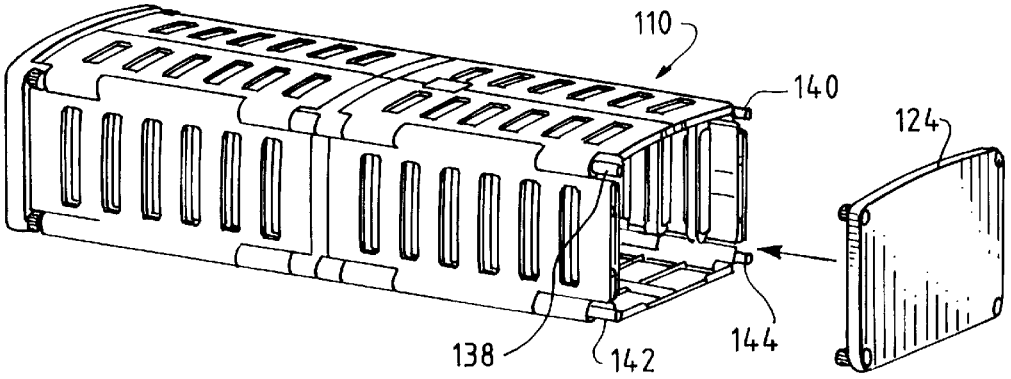
FIG. 17 illustrates the assembly step following that illustrated in FIG. 16, showing the top panel being positioned on the partially assembled cabinet.
Figure 18:
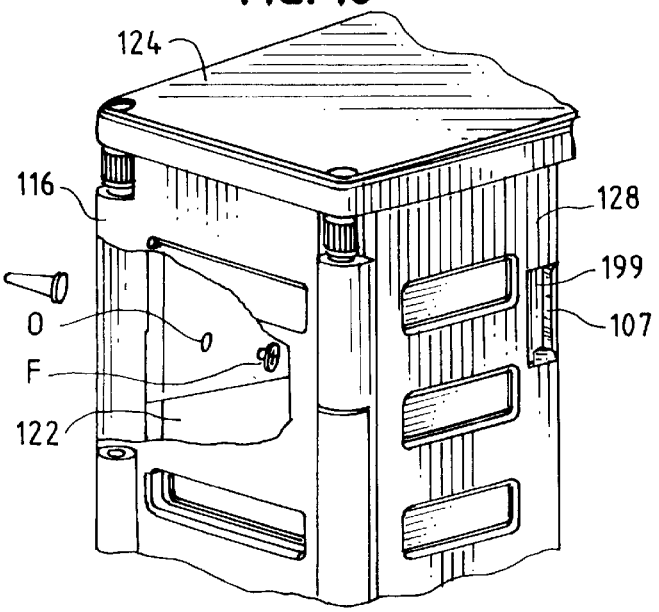
FIG. 18 is a partially broken away view of the inside rear of the cabinet illustrating a wall anchor for anchoring the cabinet to a vertical surface.
Figure 19:
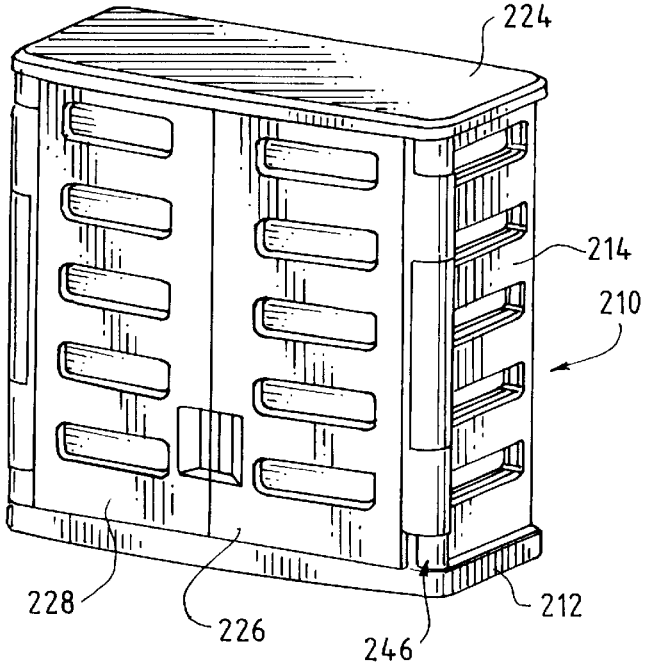
FIG. 19 is a perspective view of still another embodiment of a cabinet in accordance with the principles of the present invention, the cabinet illustrated being a wall mount-type cabinet.
Figure 20:
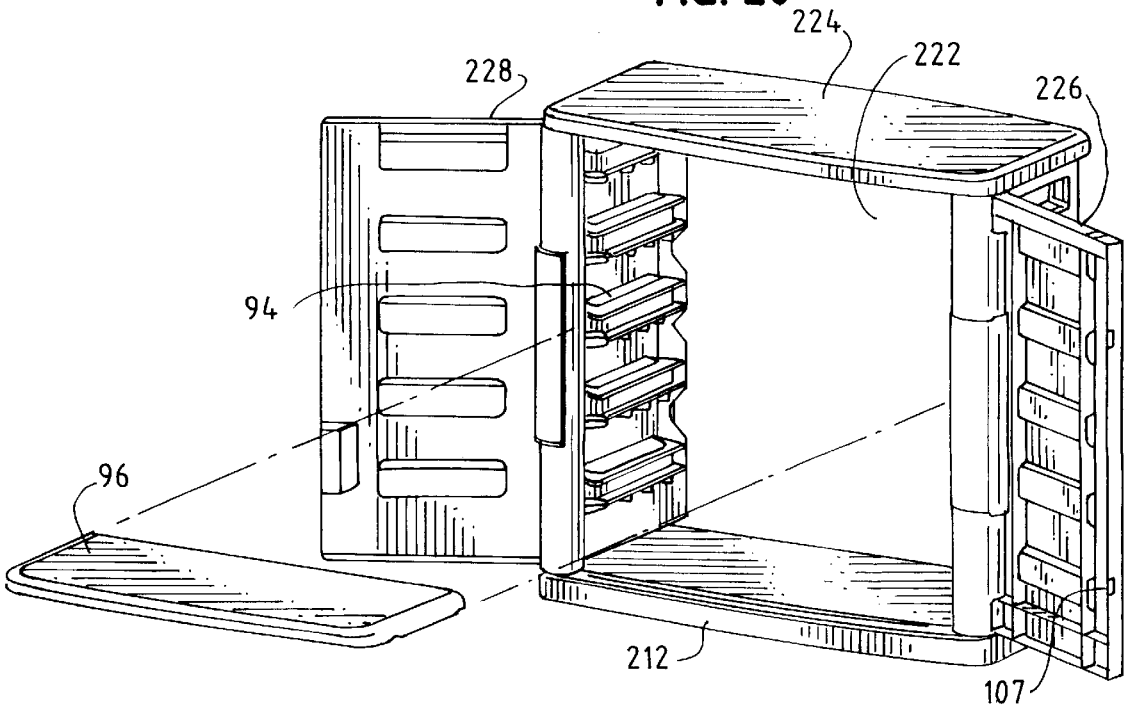
FIG. 20 is a perspective view of the cabinet of FIG. 19 illustrated with the doors in an open position, having an adjustable shelf being positioned within the cabinet.

Advantageously, the present cabinet utilizes the front support posts 38, 40 not only as structural support members, but also as hinge pintles for pivoting the front door panels 26, 28. As can be seen from the figures, and particularly FIGS. 1 and 7, each door panel 26, 28 includes upper and lower, longitudinally spaced apart hinge elements 64, 66 extending from an edge of the door 26, 28. Preferably, the hinge elements 64, 66 are formed as a pair of collinear sleeves that extend from the door 26, 28 edge, spaced from the upper and lower ends of the doors 26, 28.

The door hinge elements 64, 66 are configured so that a fixed hinge supporting member 68 extending from an edge of each side panel 14, 16 is disposed intermediate the upper and lower door hinge elements 64, 66. The hinge supporting member 68 can also be formed as a sleeve extending from an edge of the side panel 14, 16. When the side and door panels 14/26 and 16/28 are assembled to one another about their respective posts 38, 40, the hinge support members 68 and hinge elements 64, 66 form hinge regions, illustrated at 70, that extend substantially the height of the cabinet doors 26, 28, less the linear distance, illustrated at 72, that is required to accommodate the clamping members 46.

Advantageously, the present hinge region 70 configuration provides an essentially secure configuration in that the hinge, particularly at the center of the doors 26, 28 at their juncture with the side panels 14 and 16 is continuous. This configuration, which is unlike known cabinet configurations, reduces or eliminates the opportunity for the doors to be pried open and the contents of the cabinet 10 taken or otherwise vandalized.

Each post 38–40 is received in or inserted through respective hinge elements 64, 66 and hinge support members 68, and the post 38, 40 is secured into the clamping members 46. In this manner, the front doors 26, 28 pivot about the support posts 38, 40 on a structurally sound support member that extends essentially the height of the cabinet 10. This configuration provides an effective hinge arrangement without adversely affecting the function of the support post 38, 40, and facilitates maintaining the cabinet's 10 structural integrity.

The support posts 42, 44 that join the side panels 14, 16 to the rear panel 22 join these panels 14, 16, 22 in a similar manner to that that joins the side panels 14, 16 to the door panels 26, 28, except that the rear panel 22 is a rigid panel that is not intended to pivot about the posts 42, 44. Unlike known plastic or composite cabinets, the present post 38–44 arrangement prevents the cabinet 10 from sagging at the corners 30–36.

Figure 4:
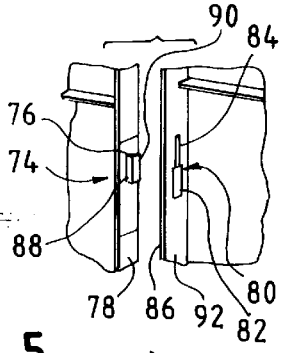
FIG. 4 illustrates the locking arrangement used to maintain the rear panels locked or engaged with one another.

Referring now to FIG. 4, there is shown a connecting arrangement, indicated at 74, that is used to connect the side-by-side rear panel sections 18, 20 to one another to form the rear panel 22. The rear panel connecting arrangement 74 includes a generally L- or hook-shaped projection 76 extending outwardly from an inner edge, indicated at 78, of one of the panel 18 faces and a corresponding two-tiered opening 80 (e.g., rectangular opening 82 and slot 84 arrangement) in the opposing panel edge 86 face. The L-shaped projection 76 includes a base leg 88 extending from the panel edge 78 face and a transverse leg 90 extending from a free end of the base leg 88.

The projection 76 and opening 80 are configured so that the entirety of the projection 76 inserts into the first larger portion 82 of the opening 80. Once the transverse leg 90 is fully inserted through the opening 82, the two panels 18, 20 can then be longitudinally adjusted relative to one another such that the base leg 88 inserts into the smaller portion 84 (e.g., slot portion) of the two-tiered opening 80. In this manner, the panels 18, 20 are locked to one another with the transverse leg portion 90 engaging an inner surface, indicated at 92, of the opposing panel 20.

Figure 2:
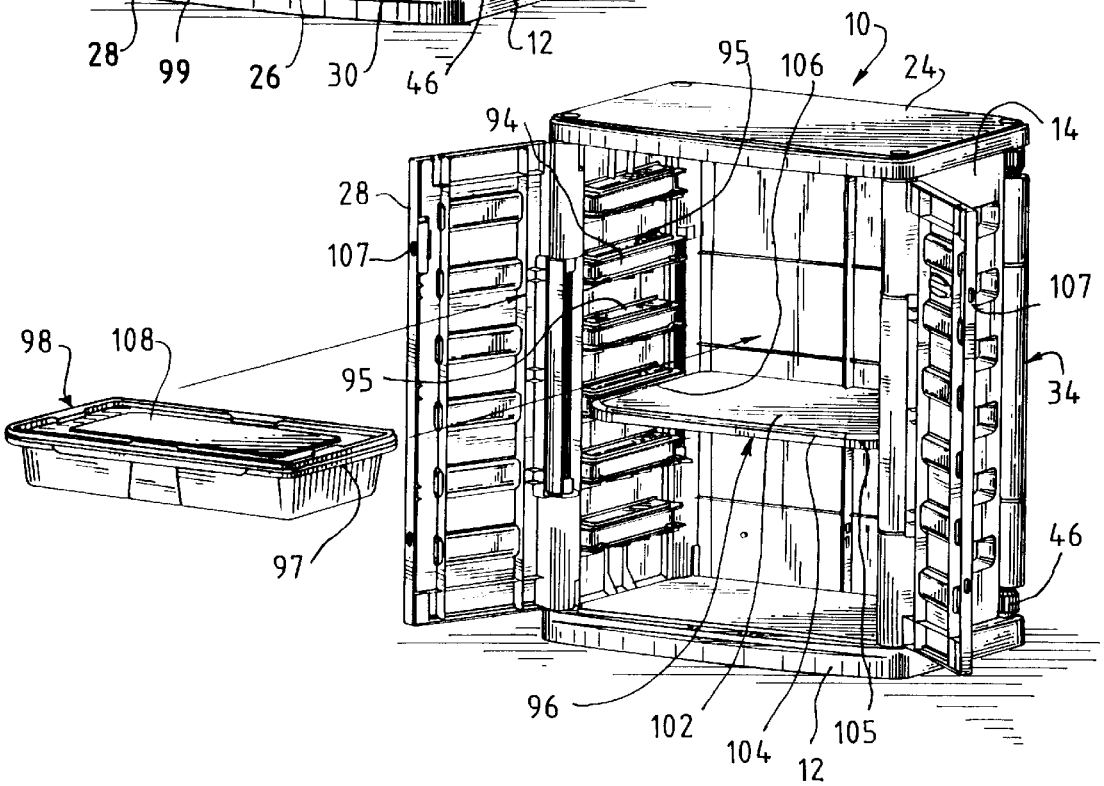
FIG. 2 is a perspective view of the cabinet of FIG. 1 illustrated with the doors in an open position, having an adjustable shelf being positioned within the cabinet and showing a removable storage bin that can be fitted to the runners of the cabinets.
Figure 3:
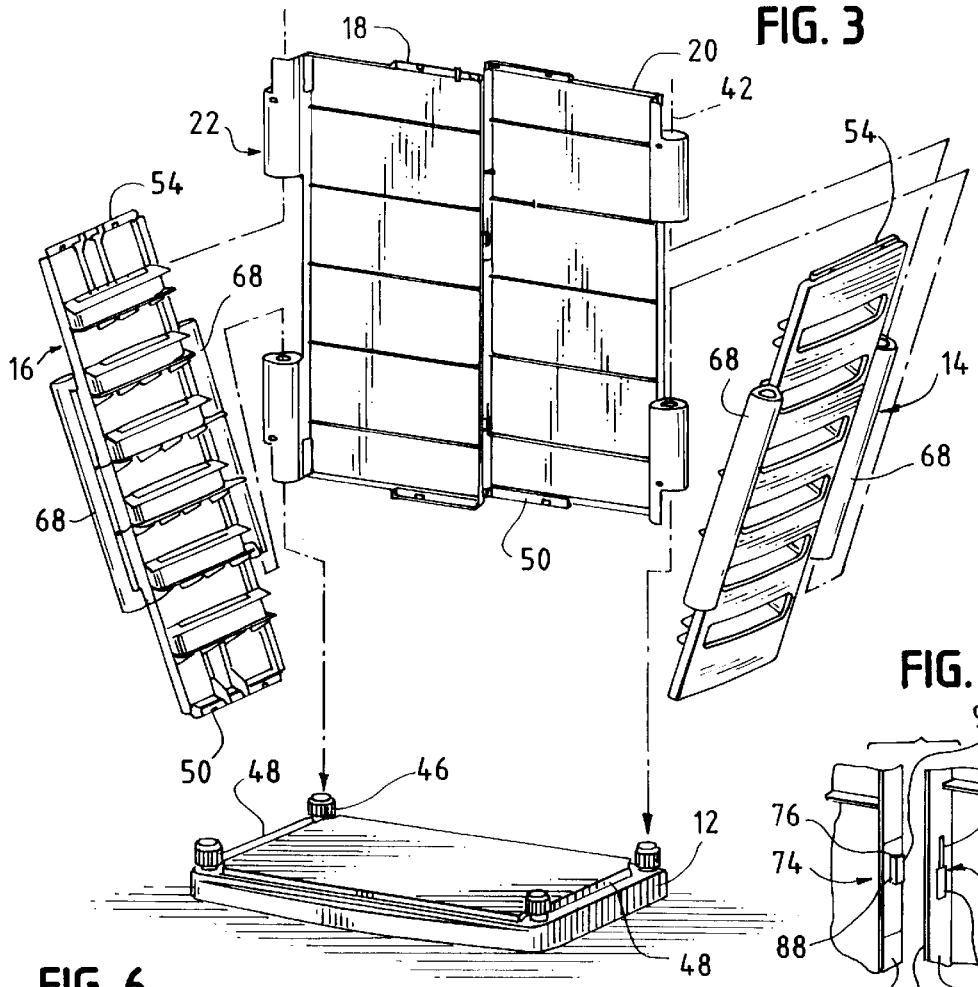
FIG. 3 is an exploded, partial view of the base-type cabinet showing the side panels and rear panels removed from the base panel.

Referring now to FIG. 2, it will be apparent from the drawings that the present cabinet 10 includes a plurality of support ledges or rails 94 that extend inwardly from each of the side panels 14, 16 to permit mounting a shelf 96 or bin 98 in the cabinet 10 interior. In a preferred embodiment, the rails 94 are formed as inwardly projecting structural rails integral with the side panels 14, 16. As will be apparent from the drawings, because the panels 14, 16 are molded elements, the rails 94 can be formed as part of the panel molds to minimize the labor necessary to manufacture such rails 94 and to permit consistency in formation of the panels 14, 16 with the rails 94 formed therein. Such consistency is necessary in order to assure that each rail 94 of a side panel, for example panel 14, is at a height equal to the height of a rail in the opposing panel 16. This assures that the shelves 96 and/or bins 98 positioned in the cabinet 10 lie in a substantially horizontal plane and are not tilted or skewed. In a preferred embodiment, the rails 94 include one or more notches 95 in an upper surface thereof that is configured to coact with one or more projections 97 extending from a bottom surface of the shelf 96 or bin 98 to maintain the shelf 96 or bin 98 securely in position when fully inserted into the cabinet 10. Alternately, the shelf 96 or bin 98 can include a notch that is complementary to a projection formed in the rail.

The shelves 96 are generally planar members that each include a flat top surface 102 and a bottom surface 104. In a preferred configuration, the shelves 96 include a raised lip 105 around the top surface 102 to prevent items stored thereon from rolling or falling off of the shelf 96. The edges 106 at the bottom surface 104 are configured to glide or slide along the side panel ledges 94. As provided above, the shelf 96 notch 95 or projection 97 coacts with a complementary projection or notch formation on the ledge 94 to provide a "locking" position for the shelf 96 when it is fully inserted into the cabinet 10. In this manner, the shelf 96 can be removed from the cabinet 10 and subsequently repositioned on a different ledge 94 at a different height within the cabinet 10, with the notch/projection arrangement providing positive "locking" by which a user is assured that the shelf 94 is securely in place in the cabinet 10.

The bins 98 are likewise configured with a bottom surface 104 that includes a notch 95 or projection 97 formed therein that coacts with the complementary projection or notch formed in the ledge 94. The bin 98 further includes a top or cover portion 108 that, in a preferred embodiment, snaps or otherwise locks into covering engagement with the bin 98.

As can be seen from the drawings, the door panels 26, 28 include recesses 99 formed therein to provide additional structural stability to the doors 26, 28. Preferably, the recesses 99 are formed to provide an aesthetically appealing look that is consistent with the side panels 14, 16. The doors 26, 28 also include a set of hand grips or handles 100 to permit grasping and opening the cabinet doors 26, 28. The doors 26, 28 each include and opening therein, illustrated at 107, preferably at about the handles 100 that align with one another. The aligned openings accommodate a locking element, such as a pad lock (not shown) so that the cabinet doors 26, 28 can be locked.

An alternate embodiment 110 of the cabinet is illustrated in FIGS. 9 through 20. This alternate embodiment 110 is a "tall" cabinet that is essentially constructed of two base cabinets joined at a central region. The tall cabinet 110 includes side panels 114, 116 and a rear panel 122 that are each formed from separate lower and upper sections (indicated as 114*a,b,* 116*a,b* and 122*a,b*, respectively) joined by bridge sections 118, 120 that interconnect these upper and lower sections.

For example, lower side section 114*a* is joined to upper side section 114*b* by bridge section 118 to form side panel 114. As can be seen from FIGS. 11 and 13–14, the bridge section 118 not only interconnects its respective upper and lower side panel sections 114*a,b,* but also provides an additional hinge supporting element, indicated at 118*a,* through which the door corner support post 138 traverses. That is, for example, bridge section 118 which connects upper and lower panels 114*a* and 114*b* also provides an additional stationary hinge point 118*a* for front door 126.

In a present embodiment, the portions 118*a,* 120*a* of the bridge sections 118, 120 through which the posts 138–144, extend have a height $h_1$ that is greater than the height $h_2$ of the portions 118*b,* 120*b* that lie adjacent the center portion of their respective panels 114, 166, 122. In this manner, the bridge portions 118, 120 provide additional support by overlapping their adjacent panels 114, 116, 122 at the edges, and by providing additional support through the door hinge locations to increase the overall structural integrity of the cabinet 110 and of the door 126, 128 hinges. As with the previously described embodiment 10, the corner posts 138–144 insert through the panels 114, 116, 122 and doors 126, 128 and are secured to the base 112 and top 124 panels by clamping means 146 at each of the corners 130–136 at each the top 124 and base 112 panels.

In this embodiment of the cabinet 110, spacers or caps 148 are positioned at the rear corners 134, 136, immediately adjacent to and collinear with the clamps 146 at the rear of the base 112 and top 124. The spacers 148 provide "filler" between the rear panel post support members 150 and the base 112 and top 124. Similar to the previous embodiment 10, the base 112 and top 124 panels include channels or slots 152 formed therein at the periphery of the panels and the side and rear panels 114, 116, 122 include corresponding, complementary projections 154 that extend therefrom to align and lock the side and rear panels 114, 116, 122 into the top 124 and base 112.

Referring now to FIGS. 19–25, there is shown still another alternate embodiment 210 of the cabinet. This embodiment 210 can be mounted to, e.g., hung from, for example, a wall or like vertical surface. Although, the tall 110 and base 10 cabinets illustrated as the second and first embodiments respectively, can also include openings O in the rear panel so that fasteners F can be inserted therethrough, it is anticipated that the base and tall cabinets will be attached to an adjacent structure such as a wall for stability, rather than "hung" as will be the wall-mount cabinet. 210

The wall mount cabinet 210 can include a flat or flush mounted rear panel 222. The flush mount rear panel 222 has a flat sheet-like rear that mounts to inwardly extending flanges 242, 244 on the side panels 214, 216, rather than the post mounted rear panel as shown in the base 10 and tall 110 cabinet embodiments. This flat rear panel 222 arrangement is configured to facilitate flush mounting the cabinet 210 to a wall or other vertical surface. It will be apparent from the figures that the wall cabinet 210 can be mounted directly to, for example, wall studs or other structural members lying in a vertical plane without an intervening wall.

Figure 21:
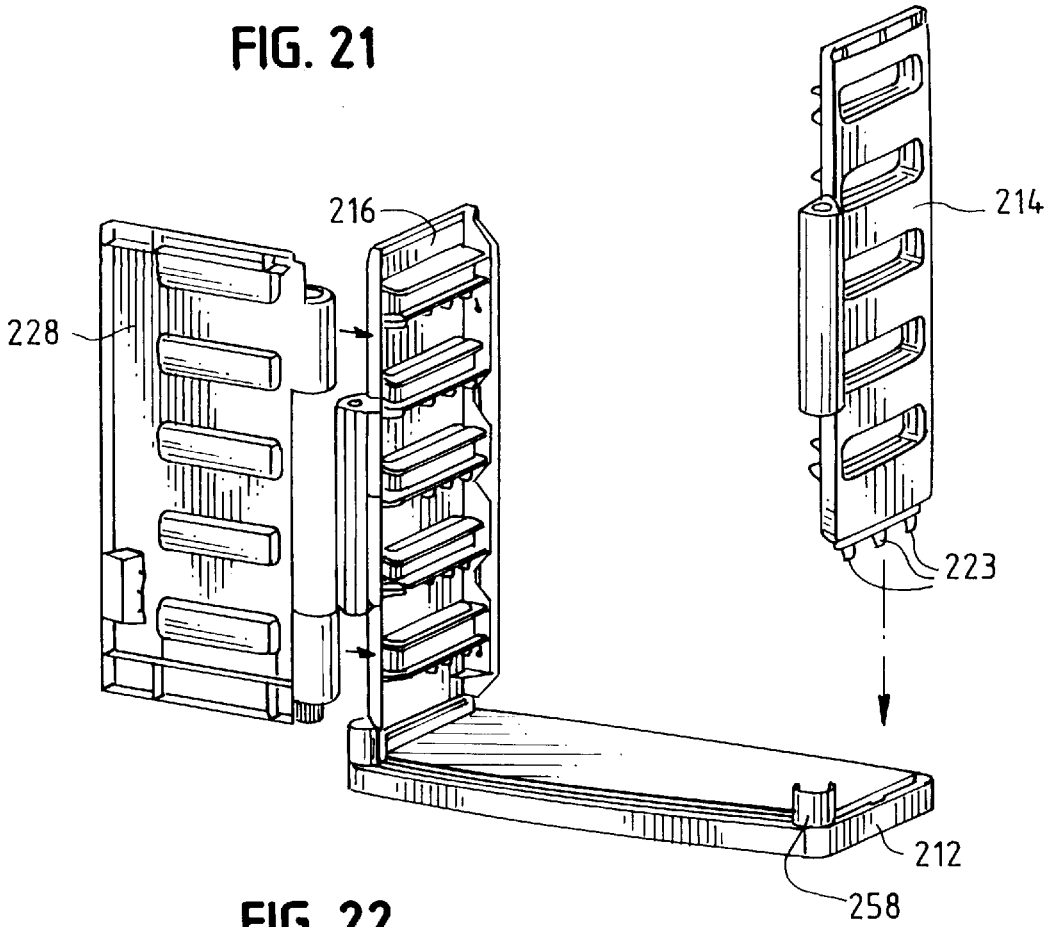
FIG. 21 is an exploded, partial view of the wall mount cabinet showing one of the side panels and the rear panel removed from the base panel, and illustrating one of the door panels in a partial assembled state with its respective side panel.
Figure 22:
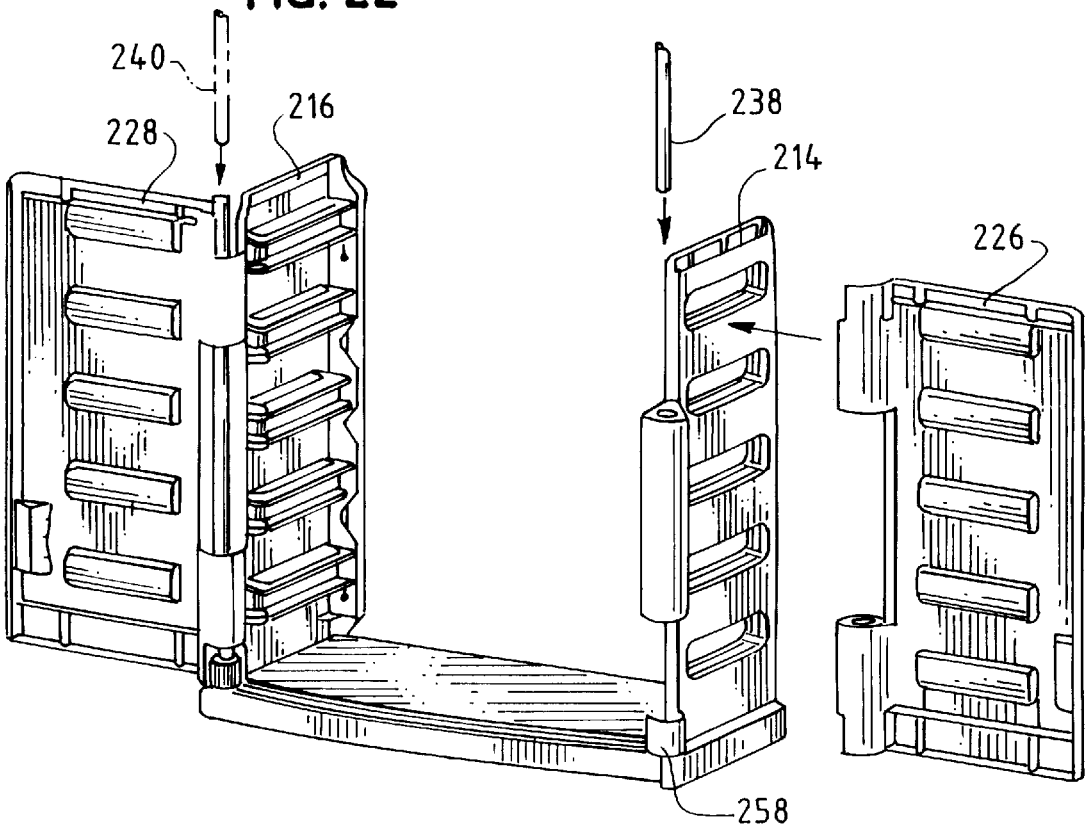
FIG. 22 is a view similar to FIG. 21 illustrating assembly of the other front door panel to the partially assembled cabinet.
Figure 23:
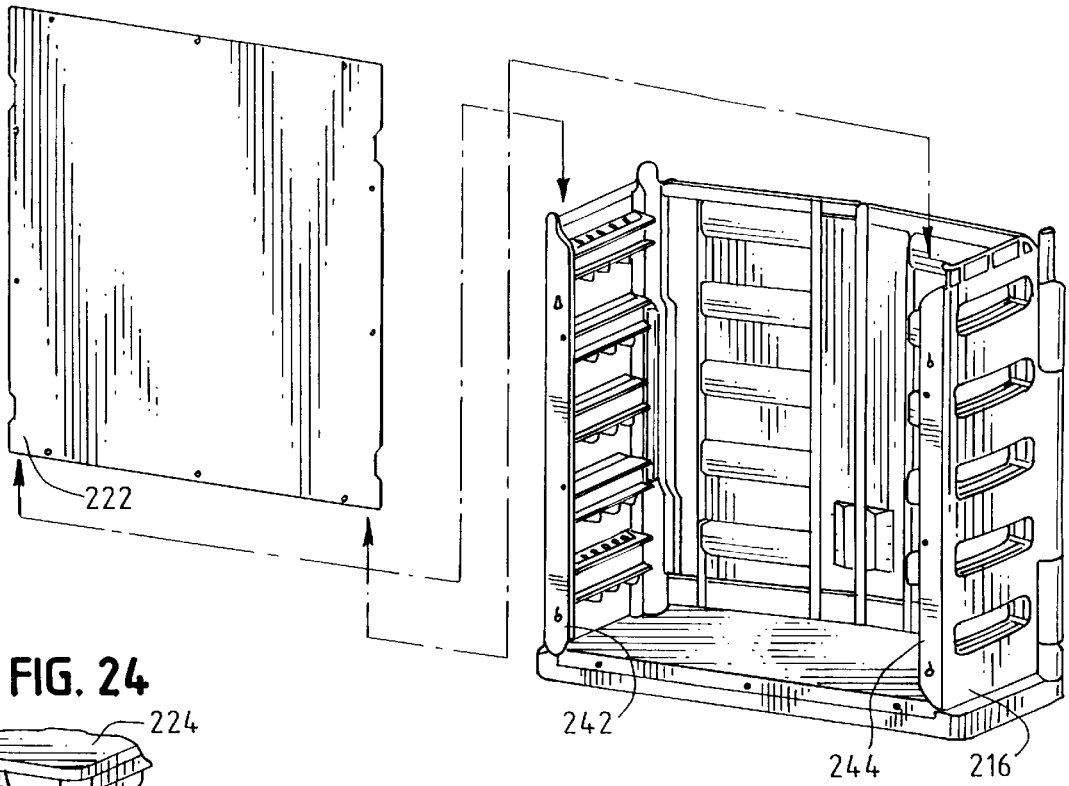
FIG. 23 is a rear perspective view of the wall mount cabinet shown with the rear panel being inserted into the partially constructed cabinet.
Figure 24:
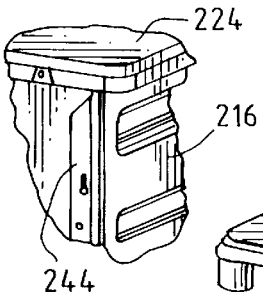
FIG. 24 is a partial view of an upper corner of the wall mount cabinet illustrating the rear panel and top panel assembled to the cabinet side panels.
Figure 25:
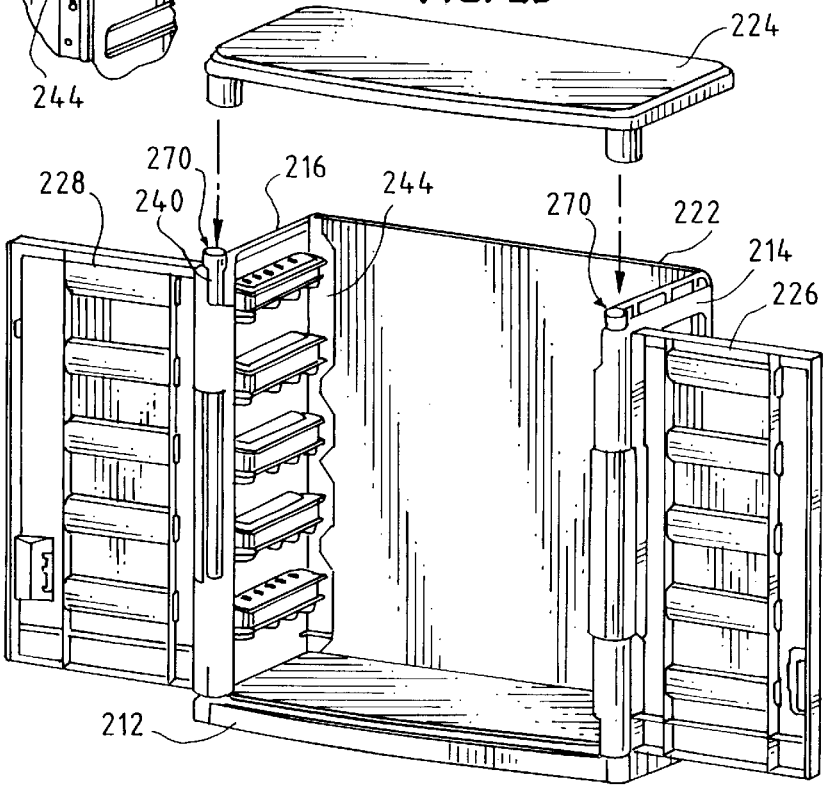
FIG. 25 is a rear perspective view of the wall-type cabinet illustrating the top panel being positioned on the cabinet.

An alternate depending tab-like arrangement, indicated at 223, is illustrated in FIG. 21. Rather than a single depending tab, the alternate arrangement includes a plurality, such as the illustrated three tabs 223, that depend from the side panels and insert into the base 212 to maintain the side panels 214, 216 aligned with the base 212. It will be apparent from the drawings that this arrangement can be used to maintain the side panels 214, 216 aligned with the top panel 224, and can also be incorporated into the previously disclosed cabinet embodiments 10, 110.

The side panels 214, 216 are otherwise joined to the door panels 226, 228 in a manner similar to that illustrated for the base 10 and tall 110 cabinets. Corner posts 238, 240 extend through hinge regions 270 of the doors 226, 228 and side panels 214, 216 and secure to the base and top panels 212, 224 by clamping means, such as the clamping members 246 illustrated in FIG. 26.

All of the parts of the present cabinet are formed of polymeric or resinous materials. The panels can be formed using known molding techniques, such as injection molding and the like. Other molding techniques that can be used to form the cabinet panels will be recognized by those skilled in the art.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A cabinet comprising:

a pair of spaced apart opposingly oriented, molded side panels;

a molded rear panel disposed between the side panels at first edges thereof and joined thereto;

a molded top panel disposed at an uppermost edge of the side and rear panels and defining a cabinet top;

a molded base panel in spaced, opposing relation to the top panel, disposed at a bottommost edge of the side and rear panels and defining a cabinet base;

a pair of pivotal, molded front door panels disposed in opposing relation to the rear panel and between the side panels and joined thereto at second edges thereof, the side panels, rear panel, top panel, base panel and door panels, when connected to one another define a cabinet having four corners and an internal storage region;

corner support posts positioned at each of the corners and extending between the base panel and the top panel, the posts traversing through and joining the respective side panels with the rear panel defining rear corners, and traversing through and joining the respective side panels with the front door panels defining front corners, the posts positioned at the front corners being pintles defining axes for pivoting the front door panels relative to the side panels; and clamping means for securing the posts to the top and base panels, at least some of the clamping means including a partially threaded sleeve formed in and extending from the base and top panels and a threaded nut configured for engaging the sleeve, the sleeve including longitudinal slots formed therein so as compress inwardly when the nut is threaded thereon, the sleeve being further configured for receiving the support post therein and for securing the support post thereto as the nut is threaded onto the sleeve and the sleeve compresses onto the post.

2. The cabinet in accordance with claim 1 wherein the rear panel is formed from a pair of side-by-side panel sections engaged with one another to form a substantially rigid panel.

3. The cabinet in accordance with clam 2 wherein one of the panel sections includes an engaging projection extending from an edge face thereof and the other of the panel sections includes an opening therein for receiving the engaging projection for engaging the panels with one another.

4. The cabinet in accordance with claim 3 wherein the engaging projection includes a base portion and a transverse portion extending from the base portion to define a generally L-shaped element, and wherein the opening includes a two-tiered configuration having a larger opening contiguous with a slot, the larger opening having an open area sufficiently large to receive the transverse portion therethrough and the slot having an open area sufficiently small to prevent the passage of the transverse portion therethrough.

5. The cabinet in accordance with claim 1 wherein one of the top and base panels includes a peripheral channel formed therein extending around at least a portion thereof, and wherein at least one of the side and rear panels includes a tab-like projection extending therefrom and configured for receipt in the channel to secure that panel to the base or top panel.

6. The cabinet in accordance with claim 5 wherein the top and base panels each include a peripheral channel formed therein extending around at least a portion thereof, and wherein the side and rear panels each include at least one tab-like projection extending therefrom and configured for receipt in the channel so as to secure that panel to the base and top panel.

7. The cabinet in accordance with claim 1 wherein the side panels include a plurality of rails formed therein, the rails being formed to correspond to rails formed in the other of the side rails and oriented inwardly of the cabinet to support one of a bin or a shelf positioned thereon extending between the side walls.

8. The cabinet in accordance with claim 7 wherein the rails include one of a projection and a notch and the shelf or bin includes a complementary notch or projection to lock the bin or shelf in place on the rail when in a fully inserted position in the cabinet.

9. A cabinet comprising:

a pair of spaced apart opposingly oriented, molded side panels;

a molded rear panel disposed between the side panels at first edges thereof and joined thereto;

a molded top panel disposed at an uppermost edge of the side and rear panels and defining a cabinet top;

a molded base panel in spaced, opposing relation to the top panel, disposed at a bottommost edge of the side and rear panels and defining a cabinet base;

a pair of pivotal, molded front door panels disposed in opposing relation to the rear panel and between the side panels and joined thereto at second edges thereof, the side panels, rear panel, top panel, base panel and door panels, when connected to one another define a cabinet having four corners and an internal storage region;

corner support posts positioned at at least two corners and extending between the base panel and the top panel, the posts traversing through and joining the respective side panels with the door panels defining front corners, the posts positioned at the front corners forming pintles defining axes for pivoting the door panels relative to the side panels; and clamping means for securing the posts to the top and base panels, wherein at least some of the clamping means includes a partially threaded sleeve formed in and extending from the base and top panels and a threaded nut configured for engaging the sleeve, the sleeve including longitudinal slots formed therein so as compress inwardly when the nut is threaded thereon, the sleeve being further configured for receiving the support post therein and for securing the support post thereto as the nut is threaded onto the sleeve and the sleeve compresses onto the post.

10. The cabinet in accordance with claim 9 wherein the rear panel is formed from a pair of side-by-side panel sections engaged with one another to form a substantially rigid panel.

11. The cabinet in accordance with claim 10 wherein one of the panel sections includes an engaging projection extending from an edge face thereof and the other of the panel sections includes an opening therein for receiving the engaging projection for engaging the panels with one another.

12. The cabinet in accordance with claim 11 wherein the engaging projection includes a base portion and a transverse portion extending from the base portion to define a generally L-shaped element, and wherein the opening includes a two-tiered configuration having a larger opening contiguous with a slot, the larger opening having an open area sufficiently large to receive the transverse portion therethrough and the slot having an open area sufficiently small to prevent the passage of the transverse portion therethrough.

13. The cabinet in accordance with claim 9 wherein each side panel includes an inwardly oriented flange extending from a rear portion thereof, and wherein the rear panel is formed from a sheet extending between and affixed to the inwardly oriented flanges.

14. The cabinet in accordance with claim 9 wherein one of the top and base panels includes a peripheral channel formed therein extending around at least a portion thereof, and wherein at least one of the side and rear panels includes a tab-like projection extending therefrom and configured for receipt in the channel so as to secure that panel to the base or top panel.

15. The cabinet in accordance with claim 14 wherein the top and base panels each include a peripheral channel formed therein extending around at least a portion thereof, and wherein the side and rear panels each include at least one tab-like projection extending therefrom and configured for receipt in the channel so as to secure that panel to the base and top panel.

16. The cabinet in accordance with claim 9 wherein the side panels include a plurality of rails formed therein, the rails being formed to correspond to rails formed in the other of the side rails and oriented inwardly of the cabinet to support one of a bin or a shelf positioned thereon extending between the side walls.

17. The cabinet in accordance with claim 16 wherein the rails include one of a projection and a notch and the shelf or bin includes a complementary notch or projection to lock the bin or shelf in place on the rail when in a fully inserted position in the cabinet.

18. The cabinet in accordance with claim 9 including corner support posts positioned at all four corners and extending between the base panel and the top panel, two of the posts traversing through and joining the respective side panels with the door panels defining front corners, the posts positioned at the front corners forming pintles defining axes for pivoting the door panels relative to the side panels, and two of the posts traversing through and joining the respective side panels with the rear panel defining rear corners.

19. A cabinet comprising:

a pair of spaced apart opposingly oriented, molded side panels;

a molded rear panel disposed between the side panels at first edges thereof and joined thereto;

a molded top panel disposed at an uppermost edge of the side and rear panels and defining a cabinet top;

a molded base panel in spaced, opposing relation to the top panel, disposed at a bottommost edge of the side and rear panels and defining a cabinet base;

a pair of pivotal, molded front door panels disposed in opposing relation to the rear panel and between the side panels and joined thereto at second edges thereof, the side panels, rear panel, top panel, base panel and door panels, when connected to one another define a cabinet having four corners and an internal storage region;

corner support posts positioned at at least two corners and extending between the base panel and the top panel, the posts traversing through and joining the respective side panels with the door panels defining front corners, the posts positioned at the front corners forming pintles defining axes for pivoting the door panels relative to the side panels; and clamping means for securing the posts to the top and base panels, wherein the clamping means includes a clamping sleeve positioned on at least one of the top and base panels, the sleeve configured for receiving a support post end therein, the support post end having a slot therein engageable with a locking projection extend from top or base panel adjacent the clamping sleeve.

20. The cabinet in accordance with claim 19 wherein the post slot includes serrations therein for frictionally engaging the locking projection.

21. The cabinet in accordance with claim 19 including a shroud sleeve extending from the top or base panel adjacent to and generally coaxial with the clamping sleeve.

22. A cabinet comprising:

a pair of spaced apart opposingly oriented, molded side panels;

a molded rear panel disposed between the side panels at first edges thereof and joined thereto;

a molded top panel disposed at an uppermost edge of the side and rear panels and defining a cabinet top;

a molded base panel in spaced, opposing relation to the top panel, disposed at a bottommost edge of the side and rear panels and defining a cabinet base;

a pair of pivotal, molded front door panels disposed in opposing relation to the rear panel and between the side panels and joined thereto at second edges thereof, the side panels, rear panel, top panel, base panel and door panels, when connected to one another define a cabinet having four corners and an internal storage region;

corner support posts positioned at at least two corners and extending between the base panel and the top panel, the posts traversing through and joining the respective side panels with the door panels defining front corners, the posts positioned at the front corners forming pintles defining axes for pivoting the door panels relative to the side panels; and clamping means for securing the posts to the top and base panels, wherein each side panel is formed from an upper and lower panel joined to one another by a bridge section.

23. The cabinet in accordance with claim 22 wherein the rear panel is formed from upper and lower panel sections joined to one another by a bridge section.

24. The cabinet in accordance with claim 22 wherein each corner support post traverses through at least one bridge section.

* * * * *